US009579538B2

(12) United States Patent
Brown

(10) Patent No.: US 9,579,538 B2
(45) Date of Patent: Feb. 28, 2017

(54) WHEELED PLATFORM FOR CORE TRAINING

(71) Applicant: Roland R. Brown, Ogden, UT (US)

(72) Inventor: Roland R. Brown, Ogden, UT (US)

( * ) Notice: Subject to any disclaimer, the term of this patent is extended or adjusted under 35 U.S.C. 154(b) by 0 days.

(21) Appl. No.: 14/674,901

(22) Filed: Mar. 31, 2015

(65) Prior Publication Data

US 2016/0287932 A1 Oct. 6, 2016

(51) Int. Cl.

| | |
|---|---|
| ***A63B 21/00*** | (2006.01) |
| ***A63B 22/20*** | (2006.01) |
| ***A63B 23/02*** | (2006.01) |
| ***A63B 21/06*** | (2006.01) |

(52) U.S. Cl.

CPC ..... *A63B 22/203* (2013.01); *A63B 21/0004* (2013.01); *A63B 21/00058* (2013.01); *A63B 21/0618* (2013.01); *A63B 21/4034* (2015.10); *A63B 21/4035* (2015.10); *A63B 23/0211* (2013.01)

(58) Field of Classification Search

USPC ..... 482/1–148

See application file for complete search history.

(56) References Cited

U.S. PATENT DOCUMENTS

| | | | | |
|---|---|---|---|---|
| 3,809,393 | A * | 5/1974 | Jones | A63B 22/20 482/132 |
| 6,582,347 | B2 * | 6/2003 | Smith | A63B 23/0216 482/140 |
| 6,942,605 | B1 * | 9/2005 | Sukhovitsky | A63B 21/0004 2/24 |
| 7,727,089 | B2 * | 6/2010 | Gilman | A63B 21/06 473/441 |
| 8,550,965 | B2 * | 10/2013 | Candela | A63B 23/0211 482/132 |
| 9,254,857 | B2 * | 2/2016 | Fiebelkorn | B62B 5/0093 |

* cited by examiner

*Primary Examiner* — Stephen Crow
(74) *Attorney, Agent, or Firm* — David R. Conklin; Kirton McConkie

(57) ABSTRACT

An exercise apparatus for training the core muscles can include a wheeled platform for supporting the upper body or the lower body while the user employs the core muscles to roll the platform across a surface. Two vertical posts can be positioned on opposite sides of the platform near a back edge of the platform to provide handles for the user when the platform is used to support the user's upper body. A third vertical post can be positioned near the center of the platform and can be used to add weights to the platform thereby increasing the difficulty of rolling the platform across a surface.

20 Claims, 6 Drawing Sheets

WHEELED PLATFORM FOR CORE TRAINING

RELATED APPLICATIONS

N/A

BACKGROUND

The present invention relates generally to an exercise apparatus that can be used to train the core muscles. In particular, the present invention is directed to a wheeled platform that can support the upper body or lower body during the performance of various exercises which target the core muscles.

The core is a complex series of muscles in the torso that primarily function as a stabilizer and force transfer center. These muscles perform a critical role in nearly all movements. In spite of their central role in human movement, many people when working out fail to adequately train the core muscles. For example, many people will perform a set of sit-ups believing that doing so will adequately strengthen the core muscles. However, sit-ups alone fail to train many of the muscles of the core.

Recently, there has been increased awareness of the importance of core strength and agility. Increasingly more exercises for training the core muscles are being recommended each day including those that require no equipment and those that do. As with any exercise, the likelihood that an individual will incorporate a core exercise into his or her exercise routine is highly dependent on the ease at which the exercise can be performed, the effectiveness of the exercise, and whether or not the exercise is enjoyable.

BRIEF SUMMARY OF THE INVENTION

The present invention extends to an exercise apparatus for training the core muscles. The exercise apparatus of the present invention comprises a wheeled platform that can be used to support the upper body or the lower body while the user employs the core muscles to roll the platform across a surface. The platform can be sized to simultaneously support either the user's feet or the user's forearms.

Two vertical posts can be positioned on opposite sides of the platform near a back edge of the platform to provide handles for the user when the platform is used to support the user's upper body. A third vertical post can be positioned near the center of the platform and can be used to add weights to the platform thereby increasing the difficulty of rolling the platform across a surface. Alternatively or additionally, the wheels may be configured to have an adjustable resistance to rolling.

The platform may be configured to allow the wheels to be positioned in a number of different orientations or to allow different numbers of wheels to be used during an exercise. These different orientations can include those that enable the platform to tip during an exercise. In such orientations, the user will be required to use greater core strength to maintain the balance of the platform during the performance of the exercise. The positioning of the handles may also be adjustable to thereby increase or decrease the difficulty of balancing the platform.

In one embodiment, the present invention is implemented as an exercise apparatus that includes: a platform having a front side, a back side, a left side, and a right side; a set of wheels attached to a bottom surface of the platform; a first and second handle that extend upwardly from a top surface of the platform, the first handle being positioned on the left side of the platform and the second handle being positioned on the right side of the platform; and a weight post that extends upwardly from the top surface of the platform, the weight post being positioned in a center of the top surface and being configured to retain weights when the weights are placed around the post.

In another embodiment, the present invention is implemented as an exercise apparatus that includes: a platform; a first, second, and third wheel attached to a bottom surface of the platform, the first wheel being positioned on a first side of the platform, the second wheel being positioned on a second side of the platform opposite the first wheel, and the third wheel being positioned on a front side of the platform such that the first, second, and third wheels form a triangular arrangement; and a first handle and a second handle that extend upwardly from a top surface of the platform, the first handle being positioned on the first side of the platform and the second handle being positioned on the second side of the platform opposite the first handle.

In another embodiment, the present invention is implemented as an exercise apparatus that includes: a platform having a left side, a right side, a front side, and a back side; a first, second, third, and fourth wheel socket contained in a bottom surface of the platform and that are positioned on the left side, right side, front side, and back side respectively of the platform; at least three wheels that are each configured to be coupled to any of the wheel sockets; and a first and second handle that extend upwardly from a top surface of the platform, the first handle being positioned on the left side of the platform and the second handle being positioned on the right side of the platform opposite the first handle.

This summary is provided to introduce a selection of concepts in a simplified form that are further described below in the Detailed Description. This Summary is not intended to identify key features or essential features of the claimed subject matter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE INVENTION

Figure 1:
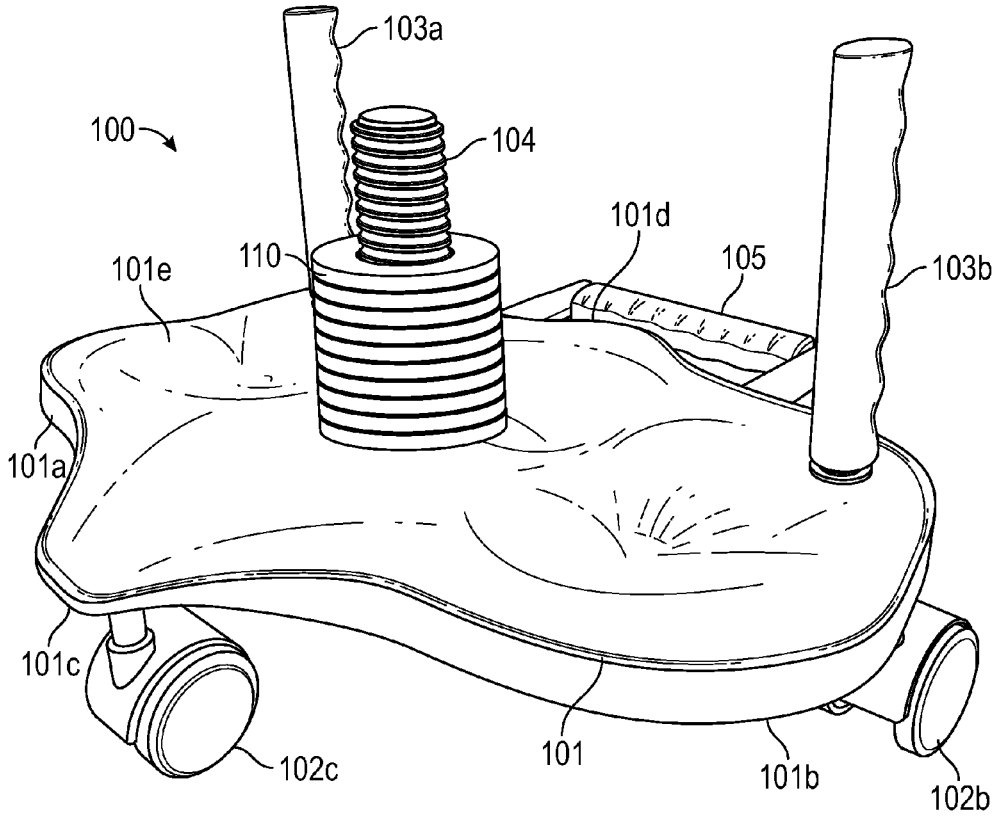
FIG. 1 illustrates a perspective view of an exercise apparatus in accordance with one or more embodiments of the present invention.
Figure 2:
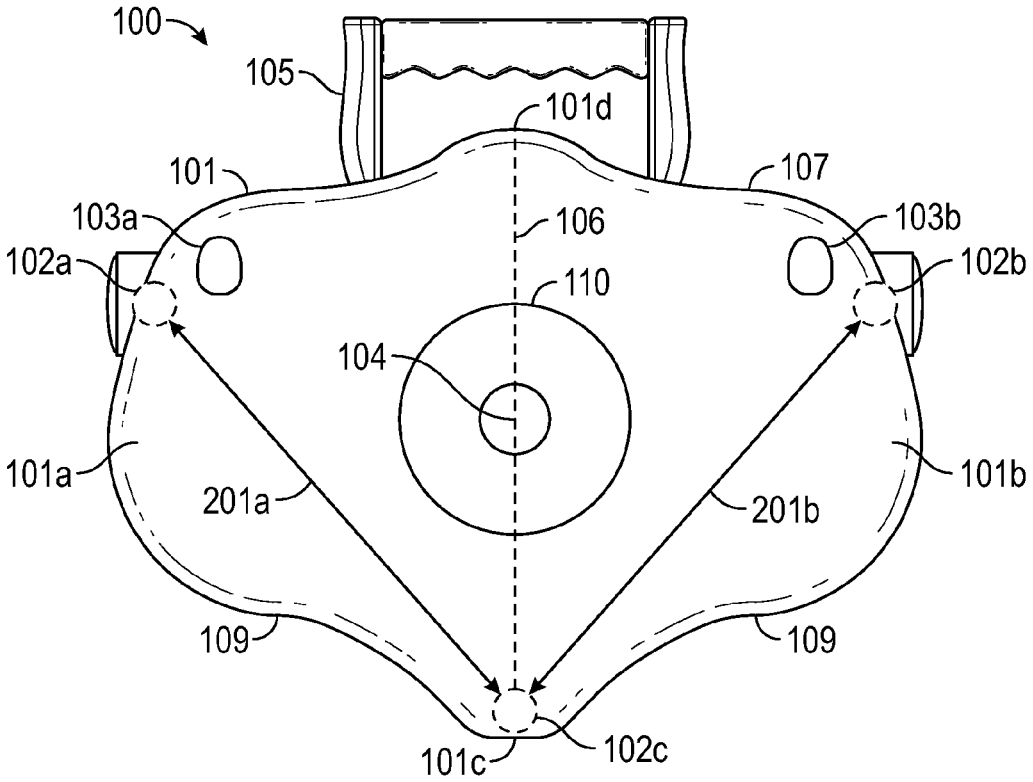
FIG. 2 illustrates a top view of the exercise apparatus of FIG. 1.

FIGS. 1 and 2 illustrate a front perspective view and a top view respectively of an exercise apparatus 100 that can be used to perform core exercises in accordance with one or more embodiments of the present invention. Exercise apparatus 100 includes a platform 101 having a left side 101*a*, a right side 101*b*, a front side 101*c*, and a back side 101*d*. A top surface 101*e* of platform 101 forms a surface on which the user can rest his feet or forearms while performing a core exercise. Accordingly, the size of platform 101 can be sufficient to provide an area on which the user's feet or forearms can be placed. Top surface 101*e* can be contoured to prevent the user's feet from sliding off platform 101 during an exercise. For example, top surface 101*e* may slope upward from back side 101*d* toward front side 101*c*. Front side 101*c* can comprise a portion of platform 101 that extends outwardly from left side 101*a* and right side 101*b* as best shown in FIG. 2.

Three vertical posts can extend upwardly from top surface 101*e*. A first set of vertical posts, handles 103*a*, 103*b*, can be positioned on the left side 101*a* and right side 101*b* respectively and near back side 101*d* to allow the user to grab the handles while resting his or her forearms on top surface 101*e*. The height of handles 103*a*, 103*b* can be at least three inches, and preferably, at least four inches to accommodate at least an average sized hand.

Handles 103*a*, 103*b* can include a contoured back surface designed to accommodate the four fingers while the user grips the posts. In some embodiments, handles 103*a*, 103*b* can be configured to be removable from platform 101. For example, platform 101 can include threaded inserts and a bottom portion of handles 103*a*, 103*b* can also be threaded to allow the posts to be screwed into the platform. In this way, handles 103*a*, 103*b* can be quickly removed if the user desires more space on top surface 101*e* such as when using wheeled platform 100 to support his or her feet. Configuring handles 103*a*, 103*b* to be removable also can facilitate storage of exercise apparatus 100.

In some embodiments, handles 103*a* and 103*b* are symmetrically positioned relative to a middle line 106 of platform 101. In some instances, handles 103*a* and 103*b* are positioned inside wheels 102*a* and 102*b*. Alternatively, handles 103*a* and 103*b* may be positioned outside of wheels 102*a* and 102*b* (not shown). In some instances, handles 103*a* and 103*b* are positioned at a distance of from approximately 12 inches to approximately 3 inches from middle line 106. In one embodiment, handles 103*a* and 103*b* are positioned at approximately 6 inches from center line 106, thereby providing a space of approximately 12 inches between the handles.

Handles 103*a* and 103*b* may also be set back from front edge 107 at any distance that provides sufficient space between the handles and the back edge 109 of platform 101 to support the user's forearms on top surface 101*e*. For example, in one embodiment handles 103*a* and 103*b* are set back from front edge 107 to provide from approximately 8 inches to approximately 14 inches from the handles to back edge 109. In one embodiment, handles 103*a* and 103*b* are set back approximately 1 inch from front edge 107 to provide a distance of approximately 10 inches between the handles and back edge 109.

In some instances, a third post, weight post 104, can be positioned at or near the center of top surface 101*e* and can function to retain weights 110 that are placed on top surface 101*e*. Top surface 101*e* can include a flat portion that surrounds weight post 104 so that weights 110 sit flush on top surface 101*e*. In some embodiments, weight post 104 and weights 110 can be threaded to allow the weights to be secured to platform 101. This can minimize the risk of injury due to weights 110 falling off during an exercise or during transport/storage of exercise apparatus 100. In some embodiments, weight post 104 may be configured to be removable from platform 101. For example, platform 101 and a bottom portion of weight post 104 can include corresponding threads to allow weight post 104 to be quickly removed such as when the user desires not to employ weights 110 during an exercise.

Exercise apparatus 100 can also include a handle 105 to facilitate transport of the exercise apparatus. Handle 105 can extend outwardly from back surface 101*d* so that the handle does not interfere with the user's motion during performance of core exercises.

In FIG. 1, exercise apparatus 100 is shown as having three wheels 102*a*-102*c* that are connected to a bottom surface of platform 101 on the left, right, and front sides of the platform. This triangular arrangement of wheels 102*a*-102*c* allows platform 101 to tip towards the left or right if the user's weight is not properly balanced on the platform. In particular, as shown in FIG. 2, a portion of left side 101*a* extends beyond a center line 201*a* between wheels 102*a*, 102*c*. If the user places unbalanced weight on this portion left of center line 201*a*, platform 101 may tip to the left. Similarly, a portion of right side 101*b* extends beyond a center line 201*b* between wheels 102*b*, 102*c*. If the user places unbalanced weight on this portion right of center line 201*b*, platform 101 may tip to the right. This tendency to tip can cause the user to employ the core muscles to retain proper balance on platform 101.

In some instances, the dimensions of platform 101 are selected to increase or decrease the stability of exercise apparatus 100 during use. For example, in some instances the distance of overhang for the left side 101*a* and right side 101*b* portions is from approximately 2 inches to 10 inches. In one embodiment, the overhang for left and right sides 101*a* and 101*b* is approximately 8 inches. In one embodiment, the overhang for left and right sides 101*a* and 101*b* is approximately 6 inches.

Figure 3:
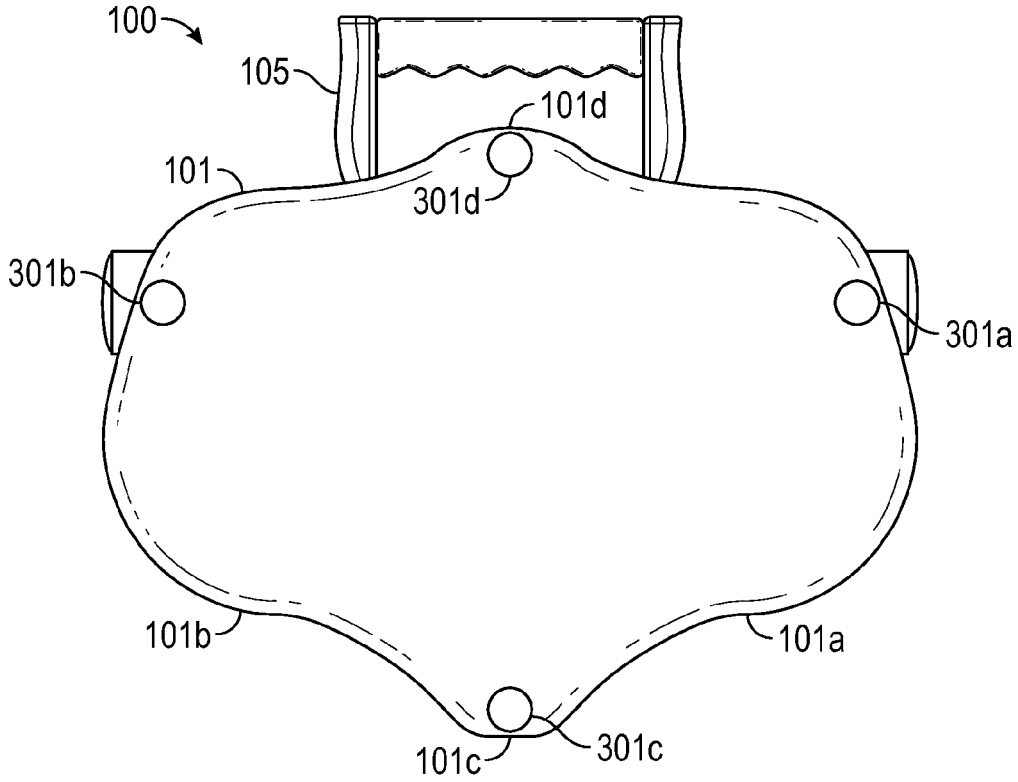
FIG. 3 illustrates a bottom view of an exercise apparatus in accordance with one or more embodiments of the present invention.

In some embodiments, the position of the wheels is adjustable. For example, FIG. 3 illustrates an embodiment of exercise apparatus 100 where the bottom surface of platform 101 includes four wheel sockets 301*a*-301*d* that are positioned on the left, right, front, and back side respectively of the platform. In FIG. 3, no wheels are depicted. However, in such embodiments, exercise apparatus 100 may include at least three wheels to allow the user to position the wheels in a desired combination of sockets 301*a*-301*d*.

Figure 3A:
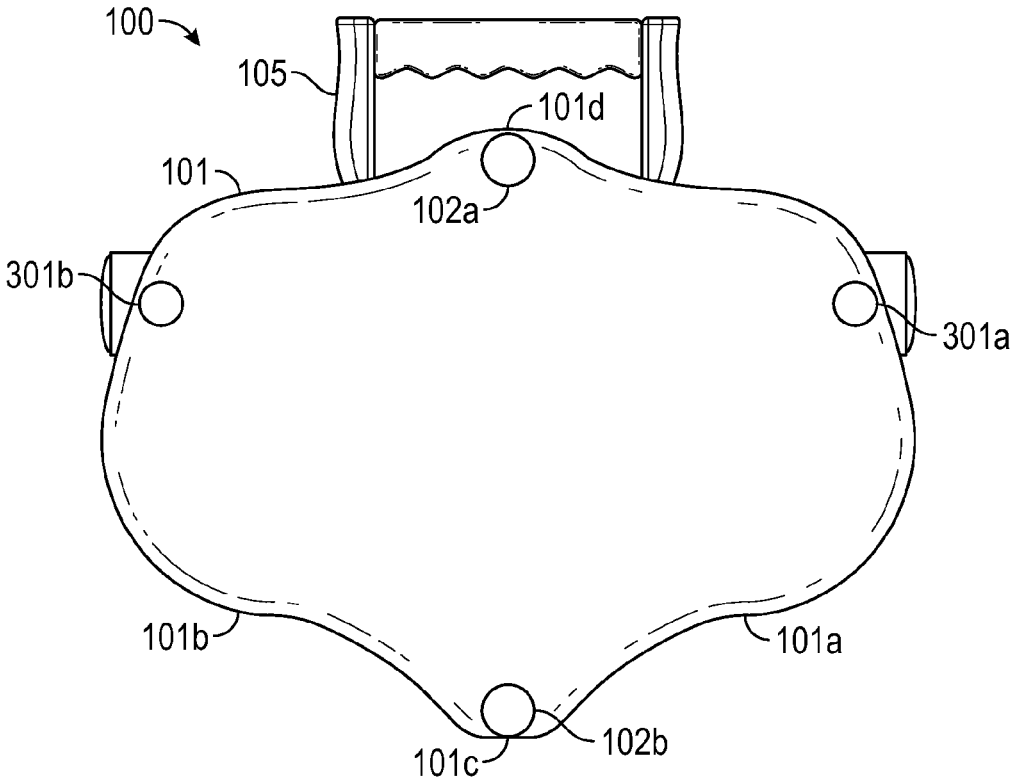
FIG. 3A illustrates the exercise apparatus of FIG. 3 when two wheels are attached at the front and back sides of the platform.
Figure 3B:
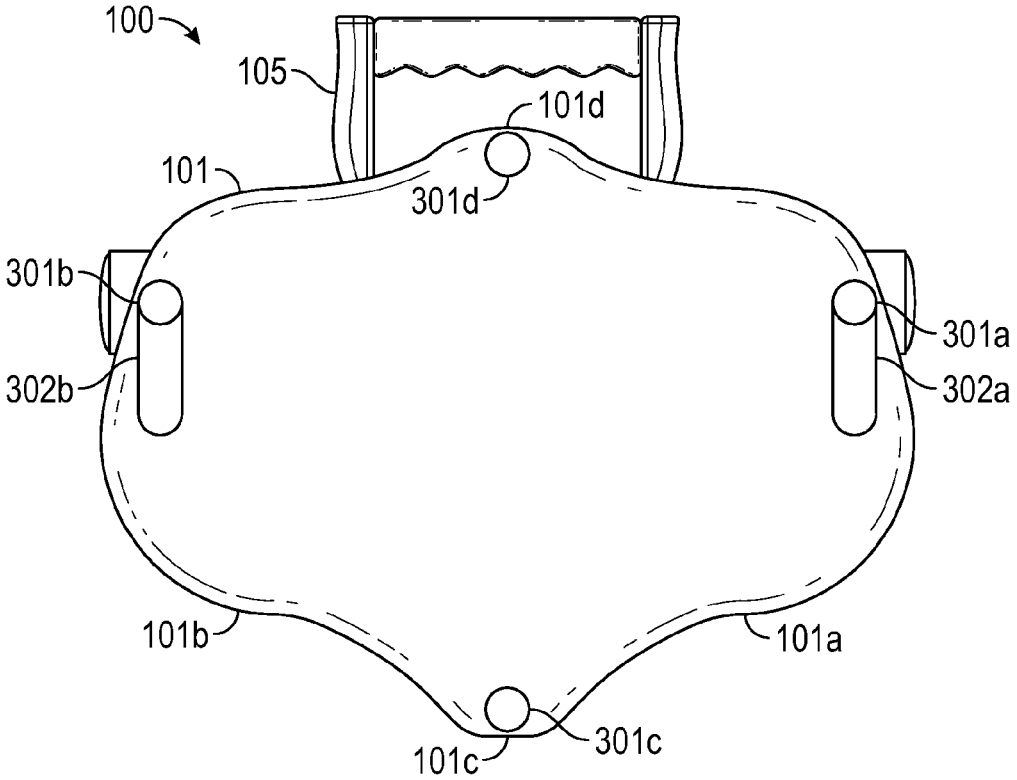
FIG. 3B illustrates a bottom view of an exercise apparatus when the platform includes adjustable wheel sockets in accordance with one or more embodiments of the present invention.

Sockets 301*a*-301*c* can correspond with the locations of wheels 102*a*-102*c* shown in FIGS. 1 and 2. Socket 301*d* can be positioned at the back side 101*d* of platform 101 opposite socket 301*c*. Sockets 301*c*, 301*d* are therefore spaced along a center line of platform 101 dividing the platform into left and right sides. In this way, two wheels 102*a*, 102*b* can be connected to platform 101 in sockets 301*c* and 301*d* as shown in FIG. 3A. With only two wheels positioned along the center line of the platform, a greater amount of balance will be required to prevent tipping of the platform during an exercise. In other words, any imbalance in the weight applied by the user's feet or forearms to platform 101 will cause the platform to rotate around the center line between sockets 301*c*, 301*d*.

Alternatively, for some exercises, it may be desirable to place two wheels in sockets 301*a*, 301*b*. With this configuration, the user will be required to use core muscles to prevent the front side 101*c* from tipping into the ground. In some embodiments, the bottom surface of platform 101 can include channels 302*a*, 302*b* within which sockets 301*a*, 301*b* can slide. Channels 302*a*, 302*b* can allow sockets 301*a*, 301*b* to be positioned closer to front side 101*c* when only two wheels are attached to platform 101 in sockets 301*a*, 301*b* thereby varying the difficulty of preventing front side 101*c* from tipping into the ground.

Figure 4:
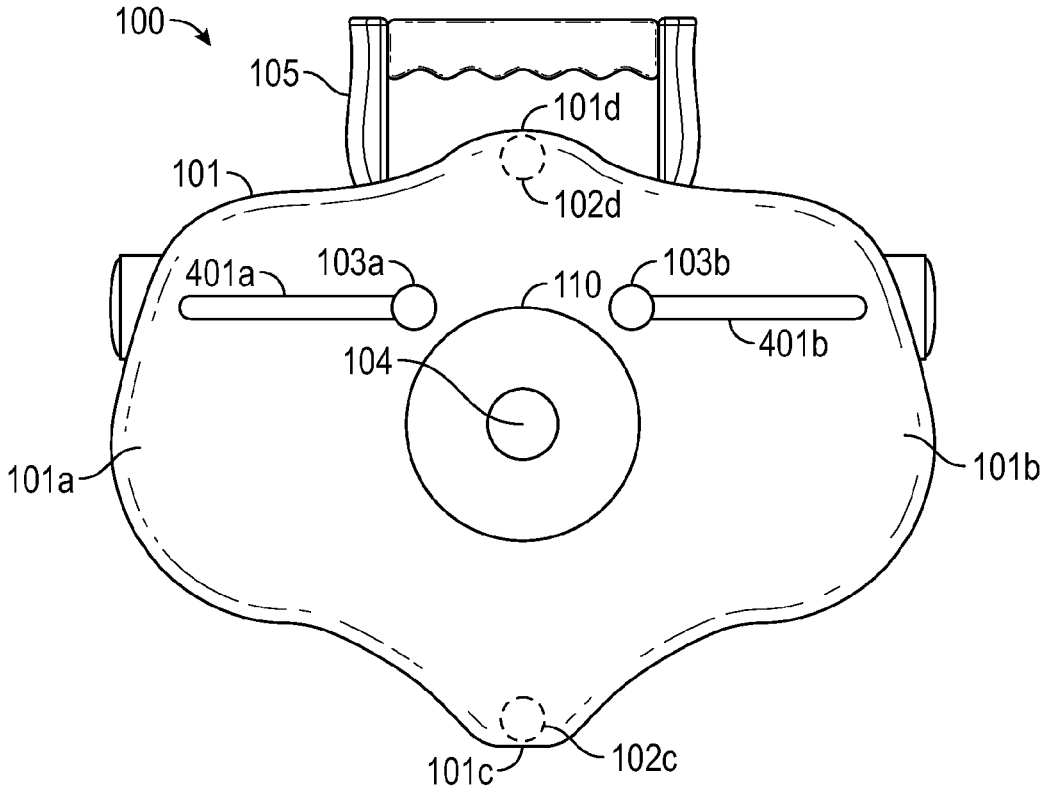
FIG. 4 illustrates a top view of an exercise apparatus when the position of the handles are adjustable in accordance with one or more embodiments of the present invention.

In some embodiments, the position of handles 103*a*, 103*b* can be adjustable. For example, FIG. 4 shows an embodiment in which top surface 101*e* of platform 101 includes channels 401*a*, 401*b* within which handles 103*a*, 103*b* can slide. In FIG. 4, handles 103*a*, 103*b* are shown as being positioned at the inside end of channels 401*a*, 401*b*. This inside post position may be used when two wheels are attached to sockets 301*c*, 301*d* as shown in FIG. 3A to thereby increase the difficulty of maintaining the balance of platform 101. As stated above, with only two wheels positioned in sockets 301*c*, 301*d*, platform 101 will tip from side to side in response to any imbalance between the feet or forearms. With handles 103*a*, 103*b* closer together (which would therefore cause the user's forearms to be closer together), any imbalance between the forearms is magnified. Therefore, the difficulty of performing an exercise is increased with handles 103*a*, 103*b* closer together.

In some embodiments, in place of or in addition to the use of weights 110, one or more of the wheels can have an adjustable resistance. In this way, the user can vary the amount of force required to roll the wheels across a surface. For example, the wheels can include a mechanism that applies a user-variable frictional force to the wheels. In many cases, users may prefer increasing the resistance of the wheels over adding weight 110 to weight post 104 since wheel resistance requires a more constant force during the movement of exercise apparatus 101. In contrast, with only weights 110, a greater initial force will be required to commence movement of exercise apparatus 100 after which the apparatus's inertia will substantially maintain the movement.

Figure 5A:
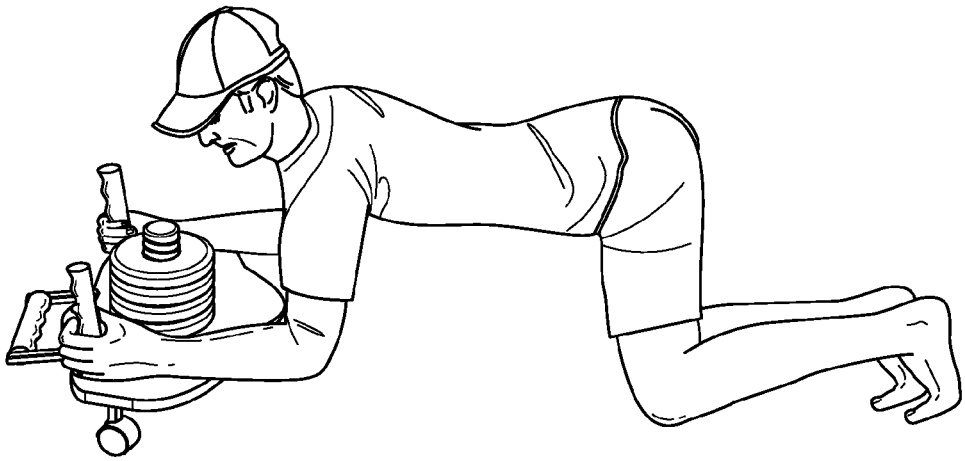
FIGS. 5A and 5B illustrate how an exercise apparatus in accordance with one or more embodiments of the present invention can be used to support the upper body during the performance of a core exercise.
Figure 5B:
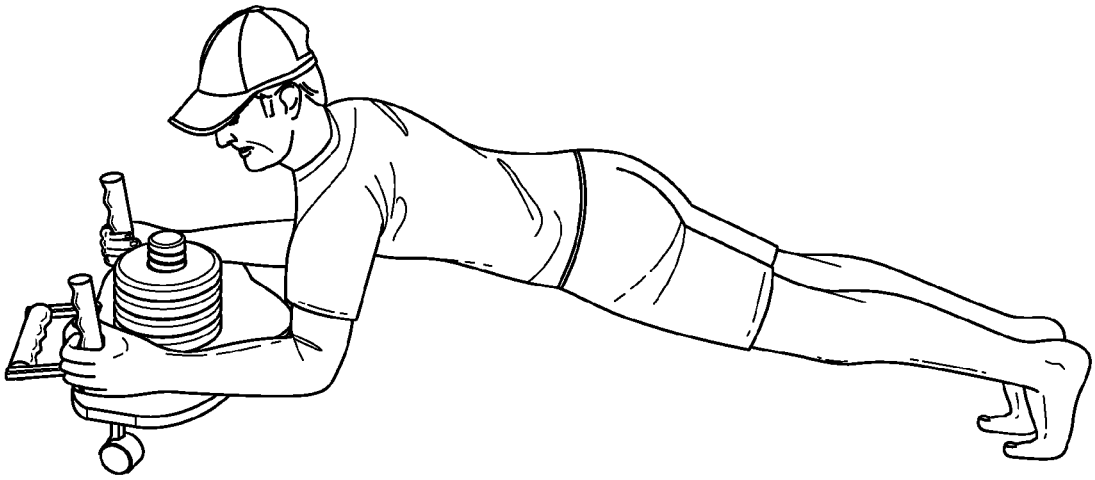

FIGS. 5A and 5B illustrate how exercise apparatus 100 can be used to perform a first exercise. As shown, the user grabs handles 103*a*, 103*b* with his hands while resting his forearms on platform 101. Initially, the user's knees and feet are positioned on the ground as shown in FIG. 5A. Then, the user extends his legs while supporting his weight between his feet and forearms which causes exercise apparatus 100 to roll along the floor. Finally, the user can employ his core muscles to return to the position shown in FIG. 5A. As discussed above, if the user's weight is imbalanced between his forearms, platform 101 can tend to tip due to the portions of the platform that extend beyond the center lines 201*a*, 201*b*. This tipping tendency can require the user to engage his core muscles to retain proper balance throughout the exercise.

Figure 6A:
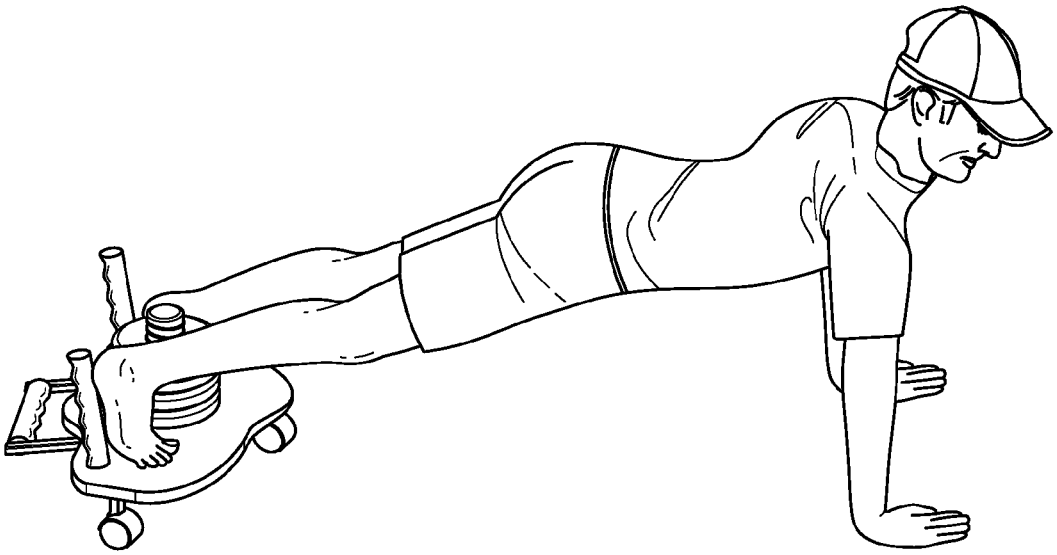
FIGS. 6A and 6B illustrate how an exercise apparatus in accordance with one or more embodiments of the present invention can be used to support the lower body during the performance of a core exercise.
Figure 6B:
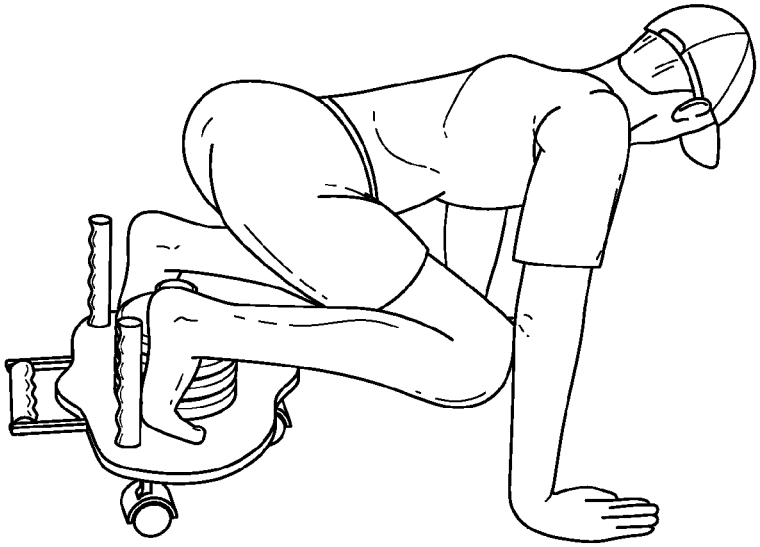

FIGS. 6A and 6B illustrate how exercise apparatus 100 can be used to perform a second exercise. As shown, the user places his feet on platform 101 adjacent posts 103*a*, 103*b*. The user may then support his weight between his hands and feet in a push-up position as shown in FIG. 6A. The user can employ his core muscles to pull exercise apparatus 100 toward his hands as shown in FIG. 6B. During this exercise, the tipping tendency of platform 101 will require the user to maintain his feet in the proper position and in proper balance.

During the performance of these exercises, the user may also employ side to side movements to target different core muscles. Also, these exercises are only examples of the many different types of exercises that can be performed using exercise apparatus 100. Although FIGS. 5A, 5B, 6A, and 6B illustrate an embodiment of exercise apparatus 100 having three wheels connected in the triangular configuration of FIGS. 1 and 2, any other wheel configuration could be employed. Similarly, an embodiment of exercise apparatus 100 having adjustable handles 103*a*, 103*b* could also be employed when performing these exercises.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description.

What is claimed:

1. An exercise apparatus comprising:

a platform having a front side, a back side, a left side, and a right side;

a set of wheels attached to a bottom surface of the platform;

a first and second handle that extend upwardly from a top surface of the platform, the first handle being positioned on the left side of the platform and the second handle being positioned on the right side of the platform; and a weight post that extends upwardly from the top surface of the platform, the post being positioned in a center of the top surface and being configured to retain weights when the weights are placed around the post.

2. The exercise apparatus of claim 1, wherein the set of wheels comprise a first wheel attached at the left side, a second wheel attached at the right side, and a third wheel attached at the front side.

3. The exercise apparatus of claim 2, wherein a portion of the left side of the platform extends outwardly beyond a first center line formed between the first wheel and the third wheel, and a portion of the right side of the platform extends outwardly beyond a second center line formed between the second wheel and the third wheel.

4. The exercise apparatus of claim 3, wherein the portion of the left side of the platform extends at least two inches beyond the first center line, and the portion of the right side of the platform extends at least two inches beyond the second center line.

5. The exercise apparatus of claim 1, wherein the bottom surface of the platform includes a first socket positioned at the left side of the platform, a second socket positioned at the right side of the platform, a third socket positioned at the front side of the platform, and a fourth socket positioned at the back side of the platform, the first, second, third, and fourth sockets each being configured to receive each of the wheels such that the wheels can be attached to the platform in different configurations.

6. The exercise apparatus of claim 5, wherein the third and fourth sockets are arranged along a center line that divides the platform into the left and right sides.

7. The exercise apparatus of claim 5, wherein the first socket is adjustably positioned in a first channel that extends between the front side and the back side, and the second socket is adjustably positioned in a second channel that extends between the front side and the back side thereby allowing the position of corresponding wheels that are attached to the first and second sockets to be adjusted.

8. The exercise apparatus of claim 1, wherein the first handle is adjustably positioned within a first channel that extends between the left side and a center of the platform, and the second handle is adjustably positioned within a second channel that extends between the right side and the center of the platform thereby allowing the distance between the first and second handles to be adjusted.

9. The exercise apparatus of claim 1, wherein at least some of the wheels have a variable resistance.

10. The exercise apparatus of claim 1, further comprising:

a third handle that extends outwardly from the back side of the platform.

11. The exercise apparatus of claim 1, further comprising:

one or more weights that are configured to couple to the post.

12. The exercise apparatus of claim 11, wherein the post and the one or more weights are threaded.

13. An exercise apparatus comprising:

a platform;

a first, second, and third wheel attached to a bottom surface of the platform, the first wheel being positioned on a first side of the platform, the second wheel being positioned on a second side of the platform opposite the first wheel, and the third wheel being positioned on a front side of the platform such that the first, second, and third wheels form a triangular arrangement;

a first handle and a second handle that extend upwardly from a top surface of the platform, the first handle being positioned on the first side of the platform and the second handle being positioned on the second side of the platform opposite the first handle; and a weight post that extends upwardly from the top surface of the platform, the weight post being positioned in a center of the top surface.

14. The exercise apparatus of claim 13, wherein a portion of the first side extends beyond a center line between the first wheel and the third wheel, and wherein a portion of the second side extends beyond a center line between the second wheel and the third wheel.

15. The exercise apparatus of claim 13, wherein the first and second wheels are removable from the platform, and at least one of the first or second wheels is attachable to the platform at a back side of the platform opposite the third wheel.

16. The exercise apparatus of claim 13, wherein a position of each of the first and second handles is adjustable.

17. An exercise apparatus comprising:

a platform having a left side, a right side, a front side, and a back side;

a first, second, third, and fourth wheel socket contained in a bottom surface of the platform and that are positioned on the left side, right side, front side, and back side respectively of the platform;

a wheel set consisting of three wheels that are each configured to be coupled to any of the wheel sockets;

a first and second handle that extend upwardly from a top surface of the platform, the first handle being positioned on the left side of the platform and the second handle being positioned on the right side of the platform opposite the first handle; and a weight post that extends upwardly from the top surface, the weight post being configured to retain weights when the weights are placed on the top surface.

18. The exercise apparatus of claim 17, wherein a portion of the first side of the platform extends beyond a center line between the first and third wheel socket, and a portion of the second side of the platform extends beyond a center line between the second and third wheel sockets.

19. The exercise apparatus of claim 17, wherein at least one wheel of the wheel set has a variable resistance.

20. The exercise apparatus of claim 17, wherein a position of each of the first and second handles is adjustable.

* * * * *